US007798061B2

(12) United States Patent
Dilou

(10) Patent No.: US 7,798,061 B2
(45) Date of Patent: Sep. 21, 2010

(54) PORTABLE AIRBRUSH WITH IMPROVED PAINT MECHANISM AND STENCIL ASSEMBLY

(76) Inventor: Carolin Dilou, 3955 W. Windrose, Phoenix, AZ (US) 85029

( * ) Notice: Subject to any disclaimer, the term of this patent is extended or adjusted under 35 U.S.C. 154(b) by 1731 days.

(21) Appl. No.: 10/897,266

(22) Filed: Jul. 22, 2004

(65) Prior Publication Data

US 2005/0016448 A1 Jan. 27, 2005

Related U.S. Application Data

(60) Provisional application No. 60/490,287, filed on Jul. 24, 2003.

(51) Int. Cl.
*B41N 1/24* (2006.01)
*B05B 7/28* (2006.01)
*A45D 29/18* (2006.01)

(52) U.S. Cl. ..... 101/127.1; 101/127; 101/128.1; 239/340; 239/525; 132/73

(58) Field of Classification Search ..... 101/127, 101/114, 127.1, 128, 128.1; 132/200, 285, 132/319, 73, 73.5, 72.6, 74.5; 239/340, 525, 239/341, 418, 345, 346
See application file for complete search history.

(56) References Cited

U.S. PATENT DOCUMENTS 1,166,522 A * 1/1916 Holton ..... 239/341
1,429,537 A * 9/1922 Rothermund ..... 239/340
1,878,435 A * 9/1932 Bramsen et al. ..... 239/341
2,020,100 A * 11/1935 Boyd ..... 434/100
4,023,524 A * 5/1977 Goldfarb et al. ..... 118/301
5,131,598 A 7/1992 Hoogeveen
5,427,121 A 6/1995 Polito
5,454,517 A * 10/1995 Naemura ..... 239/390
5,873,375 A 2/1999 Johnson
6,213,131 B1 4/2001 Vien et al.

* cited by examiner

*Primary Examiner*—Leslie J Evanisko
(74) *Attorney, Agent, or Firm*—Etherton Law Group, LLC; Sanora L. Etherton; AnnMarie W. Whitley

(57) ABSTRACT

A portable airbrush with improved mechanisms for aerosolizing paint and for facilitating stenciling. The device utilizes an air compressor that is compact, portable and relatively lightweight. The air compressor is housed in a base that has projections to hold stencils in positions that make it easier for a person to spray his or her own nails. The stencils are removably attached to the projections with stencil fasteners. The mechanism for aerosolizing the paint arranges an air-emitting nozzle, a paint-emitting needle, and its attached paint reservoir in such a way that when the nozzle and paint reservoir are removed from the wand, substantially no residual paint remains in the wand. The air compressor may be battery-powered or powered by house current, and the device may be packaged in a case with numerous stencils and refillable bottles of paint.

3 Claims, 8 Drawing Sheets

PORTABLE AIRBRUSH WITH IMPROVED PAINT MECHANISM AND STENCIL ASSEMBLY

CROSS-REFERENCE TO RELATED APPLICATIONS

This application claims the benefit of U.S. Provisional Application No. 60/490,287 filed Jul. 24, 2003.

FIELD OF INVENTION

This invention relates generally to airbrushes used for spraying colored patterns on fingernails, toenails, skin, or other surfaces. The invention relates more specifically to a compact, portable airbrush with improved mechanisms for aerosolizing the paint and facilitating stenciling.

BACKGROUND

Airbrushes are used to paint thin coats of paint, fingernail polish, ink, dyes, pigments, and other coatings on various surfaces. Substances applied with an airbrush are referred to collectively herein as "paint," and the act of applying them is referred to herein as "painting." The act of converting the substance from its original form to what emanates from the air brush is referred to herein as "aerosolizing" the paint. Of particular interest, airbrushes are used to apply paint on fingernails and toenails. Solid-color nails are the easiest to paint. French manicures are more complicated, involving painting the tips of the nails white and the nail beds a more neutral color. Even more popular recently has been painting multiple colors and layers on nails in patterns of various shapes and designs. Some of the designs painted on the nails approach miniature pieces of fine art, with detailed geometric shapes, landscapes, flowers, figures, etc. Because self-application of designs is very difficult, most people go to a salon for their manicures and pedicures, where they can obtain the services of trained and experienced nail technicians.

Some patterns are created by stenciling the nails. That is, a stencil with the desired pattern is applied to the nail, typically with adhesive, and then the paint is sprayed onto the nail. See, for example, U.S. Pat. No. 5,427,121 issued to Polito. The stencil is removed, leaving the pattern on the nail. It is known in the art to use an airbrush that is powered by a commercial-grade compressor to spray the paint. The compressor is large and heavy and is placed on the floor, as opposed to the manicure table. It typically remains in one location, stored at the foot of the nail technician's table whether it is in use or not, because it is not easily portable. It is desirable to have an airbrush that is small and compact so that it could be placed on a table, and that is easily moved and stored elsewhere between uses, particularly for home use.

Another problem with the existing equipment is that it is designed for a nail technician to use on another person's hands. It is nearly impossible to paint one's own nails with known airbrush equipment, because while one hand is being painted, the other is holding the airbrush wand, and an additional hand(s) is needed to hold the stencil in place. It would be desirable to have a mechanism to make painting one's own nails easier.

Further, commercial airbrushes are designed with a wand that has a tiny bowl (hopper) to receive the desired paint. See, for example, U.S. Pat. No. 6,213,131 issued to Viet et al. Nail polish is poured from a bottle of nail polish into the bowl in the desired amount. To change colors, the residual paint in the bowl and wand is forced out with the compressed air and a new color is poured into the bowl. This method of filling the bowl is time consuming, messy, wastes the paint remaining in the wand and can often lead to spilling the paint. Over time, the airbrush gets clogged and must be cleaned with an appropriate solvent or replaced. It is desirable to have an easier way to supply paint to the wand so that paint colors may be easily changed, with no mess or waste.

In addition to painting patterns on nails, air brushes are also used to paint patterns on other surfaces such fabric and clothing; walls; cars; signs; and even painting temporary tattoos on skin. It would be desirable to have a compact airbrush that is portable and that is battery-powered for use at remote locations.

Consequently, it would be desirable to a compact, portable airbrush that has an improved mechanism for aerosolizing the paint and changing the colors. Preferably the device will also have improved mechanism to hold stencils near one's own nails for easier self-application of fingernail polish. It is also desirable that the device be battery-powered for use in remote locations.

SUMMARY OF THE INVENTION

The present invention is a portable airbrush with improved mechanisms for aerosolizing paint and for facilitating stenciling. The device utilizes an air compressor that is compact, portable and relatively lightweight. The air compressor is housed in a base that has projections to hold stencils in positions that make it easier for a person to spray his or her own nails. The stencils are removably attached to the projections with stencil fasteners. The mechanism for aerosolizing the paint arranges an air-emitting nozzle, a paint-emitting needle, and its attached paint reservoir in such a way that when the nozzle and paint reservoir are removed from the wand, substantially no residual paint remains in the wand. The air compressor may be battery-powered or powered by house current, and the device may be packaged in a case with numerous stencils and refillable bottles of paint.

DETAILED DESCRIPTION OF THE INVENTION

Figure 1:
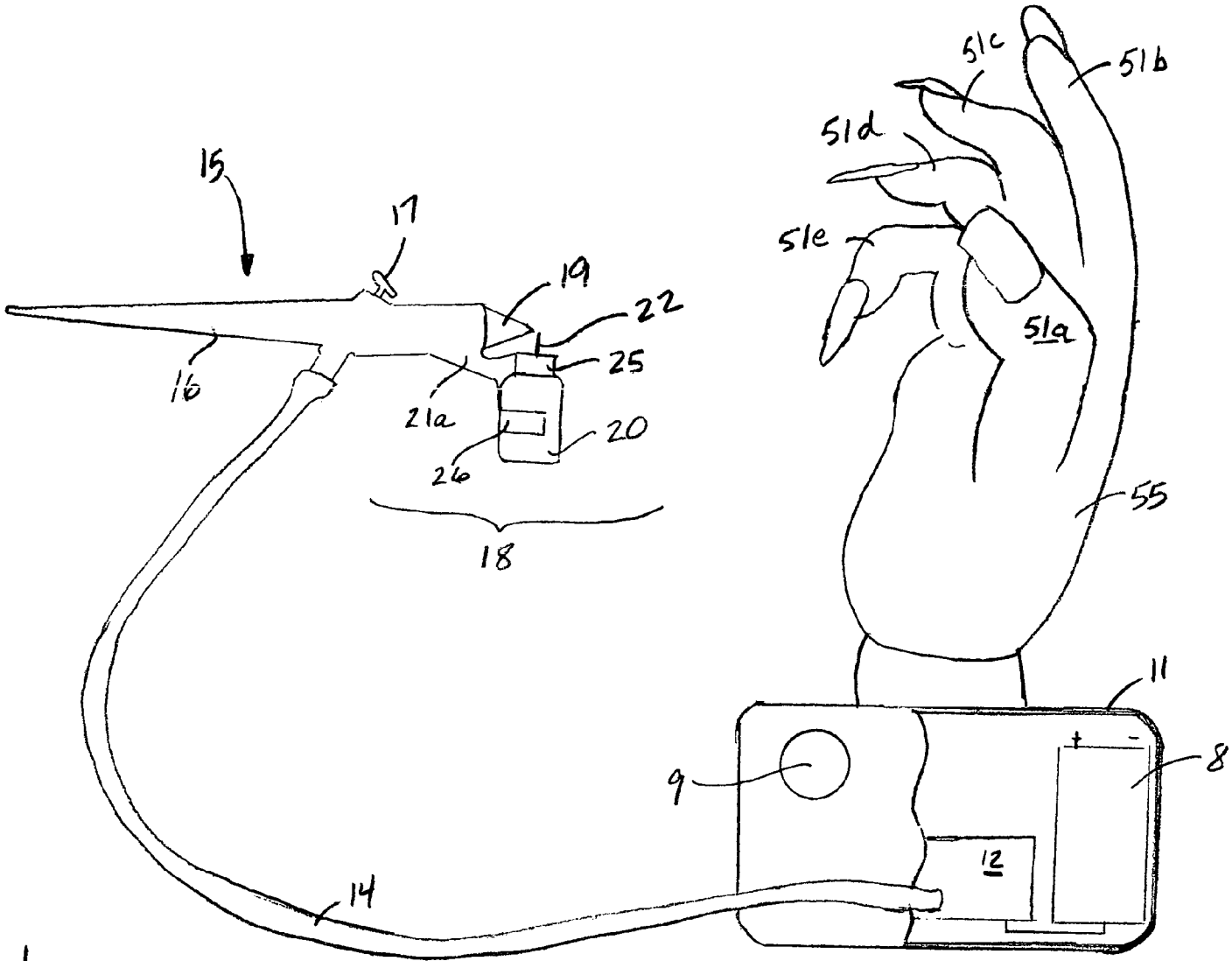
FIG. 1 illustrates a first embodiment of the device with a first embodiment of the paint assembly and a hand-shaped stencil support. The base is shown in a partial-cutaway view.

FIG. 1 illustrates the preferred embodiment of the present invention. A source of compressed air 12 is housed in a base 11. The source is small and relatively lightweight so that the housing can sit on a table, such as a manicure table, and be easily moved and stored elsewhere between uses. Preferably the source weighs less than 10 lbs. The source 12 delivers sufficient air pressure to spray thin, uniform coats of paint with few drips or spots. Preferably the source 12 is an air compressor that is capable of delivering about 0.5-1.0 cfm and maintaining up to about 35 psi. Preferably the source 12 operates at or above 10 psi. Pressure is controlled with a compressor control 9 which, in its simplest form, may be an on/off switch. Air compressors are known in the art. In the preferred embodiment, the device is powered by a battery 8. However, the device may be powered by house current. Alternatively, the source of compressed air can be provided by canisters of pressurized inert gas, such as that used for $CO_2$ guns, which are also known in the art.

Figure 2A:
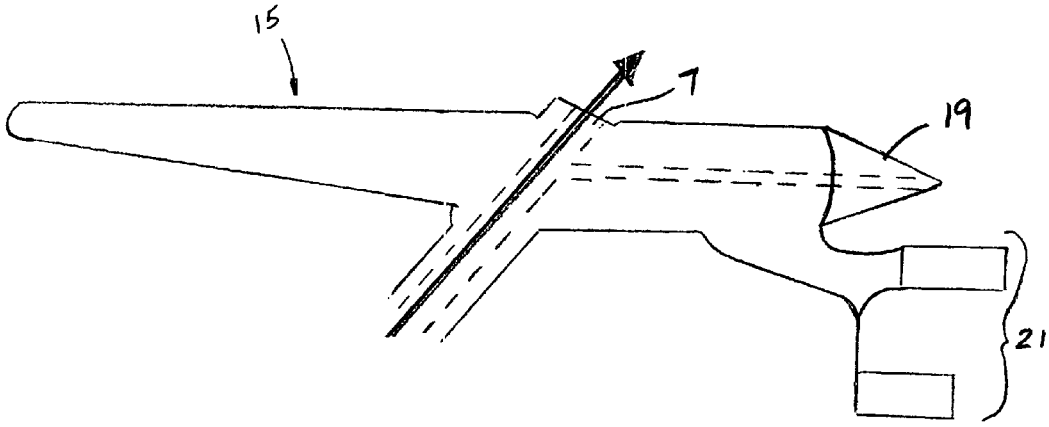
FIG. 2*a* is a plan view of the first embodiment of the paint assembly in cross-section along line 2-2 in FIG. 1, showing air flow when the aperture is open.
Figure 2B:
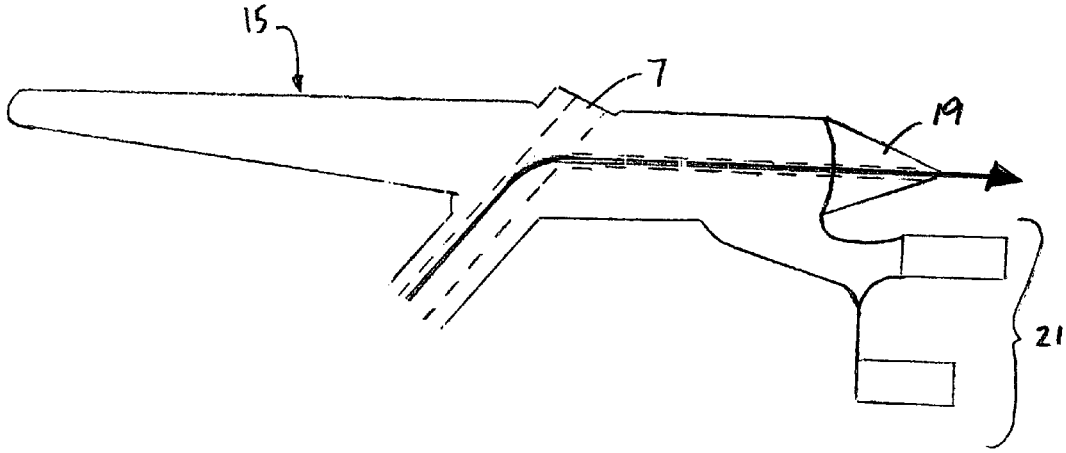
FIG. 2*b* is a plan view of the first embodiment of the paint assembly showing air flow when the aperture is closed.

An air hose 14 is connected to the source 12 to carry compressed air to the wand 15. The wand 15 comprises a grip 16, a means for controlling air flow 17, and a means for attaching the paint to the wand. FIGS. 2*a* and 2*b* show the preferred means for attaching the paint to the wand with paint assembly 18. The air flow is controlled by an aperture 7 in the wand 1 between the source of the air and the nozzle 19. See FIGS. 2*a* and 2*b*. When the aperture is open, the compressed air is vented through the wand 15 to no effect. When the aperture is closed, air is forced to pass through the nozzle 19. The means for air flow control may be a simple hole in the wand. Or, as shown in FIG. 1, it is preferably a biased piston-like knob 17 that reciprocates in the aperture and, when depressed, closes the aperture thereby shunting the air through the nozzle 19. To close the aperture, the user may simply place his or her finger over the hole or depress the knob 17.

Figure 3:
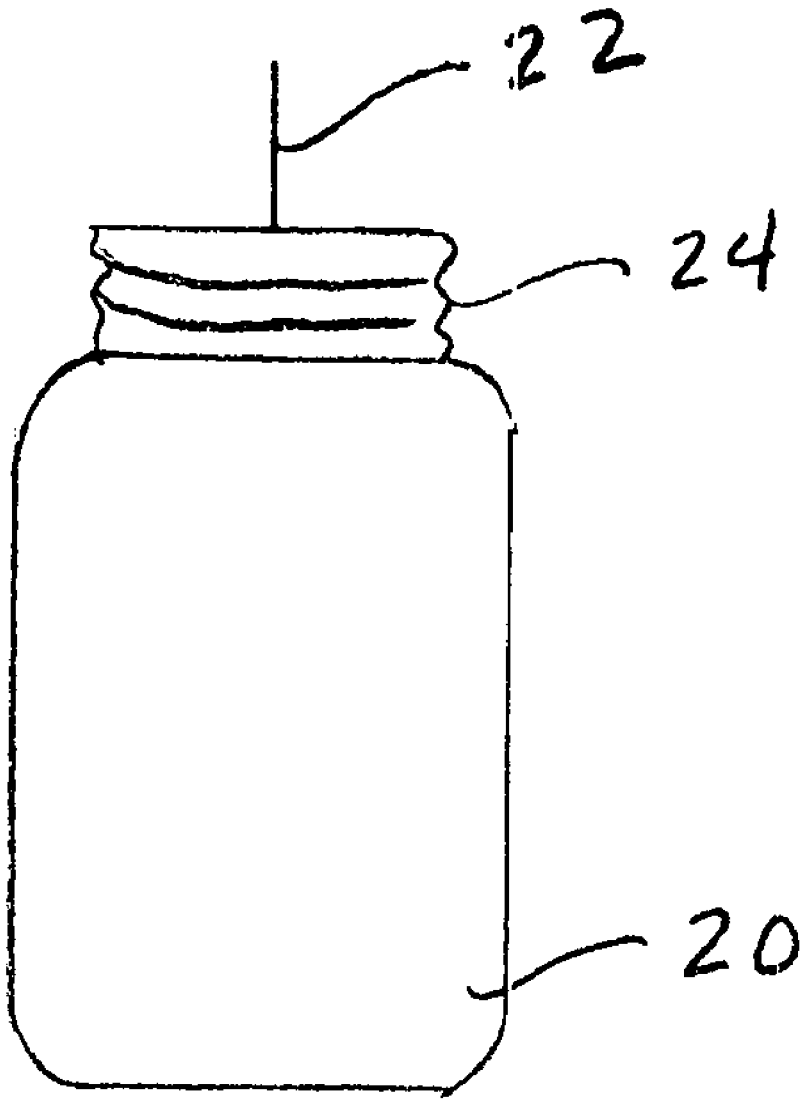
FIG. 3 is a plan view of the paint container and needle.

The paint assembly 18 comprises a nozzle 19, a container of paint 20, a means 21 for attaching the paint container 20 to the wand 15, and a needle 22 through which the paint passes. The container of paint 20 is preferably a bottle having a threaded neck 24. See FIG. 3. The needle 22 is either attached to the bottle or integral therewith. The means 21 for attaching the paint container 20 to the wand 15 is preferably an arm 21 a having a matedly-threaded collar 25 at its distal end. The paint container 20 is attached to the wand by screwing the bottle neck 24 to the collar 25. For additional security, the means 21 for attaching the paint container 20 may further include a resilient clamp 26 that extends from the wand. Ideally the means for attaching the paint container is adjustable so that the paint container may be positioned appropriately under the nozzle to most efficiently aerosolize the paint. Alternative means may be used for attaching the paint container to the wand, such as using the spring clamp alone or a snap-in arrangement.

To aerosolize the paint and achieve the desired fine spray, the aperture is closed with the flow control 17, forcing air through the nozzle 19. As the air passes over the tip of the needle 22, a pressure gradient is created, causing the paint to be drawn out of the paint container 20. As the paint mixes with the air flow, a fine spray is created. To stop the spray, the aperture is opened by allowing the knob 17 to spring back to its original position. This allows the compressed air to flow through the aperture instead of through the nozzle 19. To change paints, the paint container 20 is removed from the wand by simply unscrewing the neck from the collar. Since no paint got into the wand, the wand does not need to be cleaned prior to using a different color.

Figure 4:
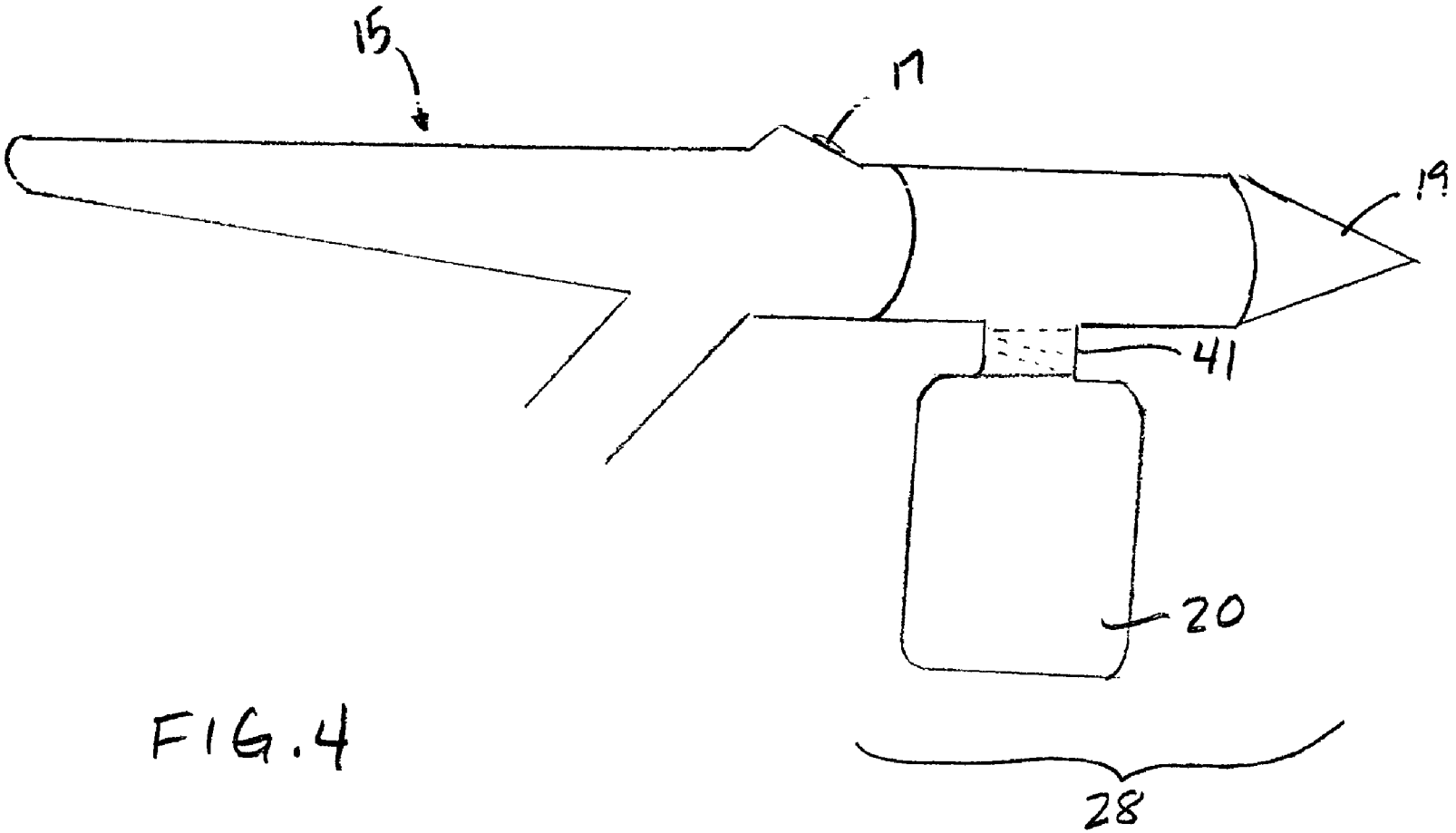
FIG. 4 is a plan view of a second embodiment of the paint assembly in cross-section.

FIG. 4 illustrates a second embodiment of the paint assembly 28. In this embodiment, the entire paint assembly 28 is removable from the wand 15. The bottle 20 is attached to the wand 15 directly in front of the nozzle 19. Preferably the paint assembly 28 snap-fits to the wand 15. As with the first embodiment, the flow is controlled by an aperture 17 in the wand between the source of the air and the nozzle 19. When the aperture is open, the compressed air is vented through the wand to no effect. However, in this second embodiment, when the aperture is closed, air is forced to pass by the paint container where it mixes with the paint before it gets to the nozzle. The aerosolized paint is forced through the nozzle to forms a fine spray.

In the second embodiment, the wand 15 has an opening 41 for receiving a paint container 20 which supplies paint to the paint reservoir. The opening is threaded to mate with the neck 24 of the paint bottle 20. Alternatively, the paint bottle can be firmly positioned in the opening with a snap-fit. The paint may be gravity fed by dripping paint downward from the attached bottle to the wand, or wick-fed in which paint is wicked upward into the wand from a container depending from the wand.

The bottles for any implementation of the present invention may be disposable or refillable.

To make it easier for the user to paint his or her own fingernails, a stencil support 55 is provided. There is at least one projection extending from the stencil support 55 that will serve to hold a stencil 52 for convenient placement on a fingernail. The stencil support 55 has one or more projections 51*a*, 51*b*, 51*c*, 51*d*, 51*e* which serve to hold one or more stencils 52. In the preferred embodiment, the stencil support 55 is attached to the base 11 and is configured to look like an up-turned palm, with five projections that are shaped like fingers with long fingernails 60. See FIG. 1. The projections' fingernails 60 may be used for practicing the airbrushing. Alternatively, the base may be configured to look like a flower, with the petals serving to hold the stencils the projections can be simple tubular extensions.

Figure 5:
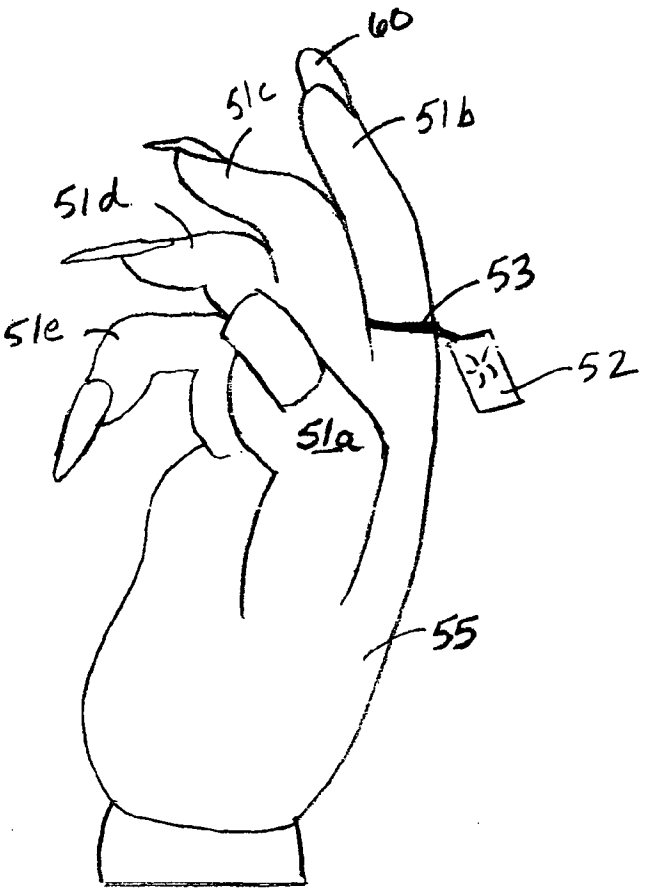
FIG. 5 illustrates a stencil assembly with a hand-shaped stencil support and finger-shaped projections.
Figure 6:
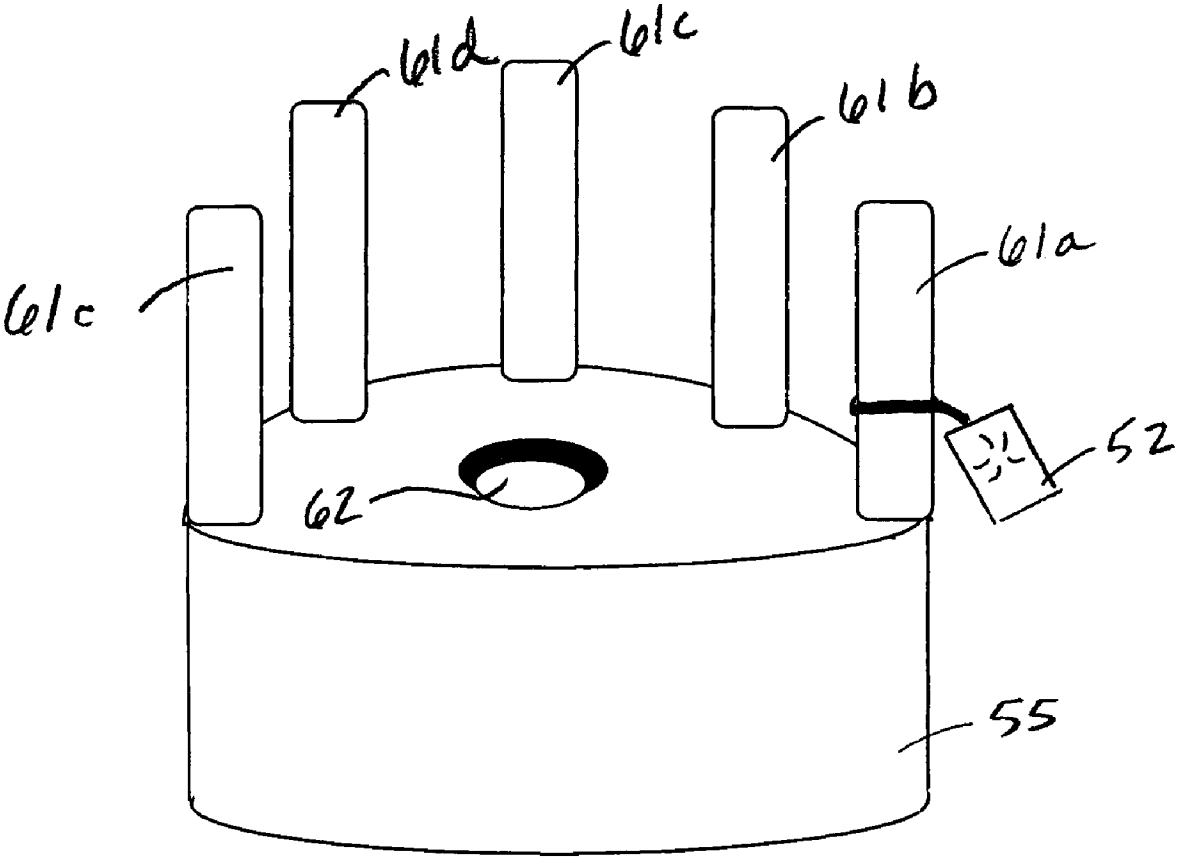
FIG. 6 illustrates a stencil assembly with simple stick projections.

While the stencil support is preferably attached to the base, it may also stand alone. See FIG. 5, for example. The stencil support may also provide an aperture 62 to hold the wand 15 when it is not in use. See FIG. 6 which shows an alternative embodiment of the stencil support with simple upright projections 61*a*, 61*b*, 61*c*, 61*d*, and 61*e*.

Figure 7A:
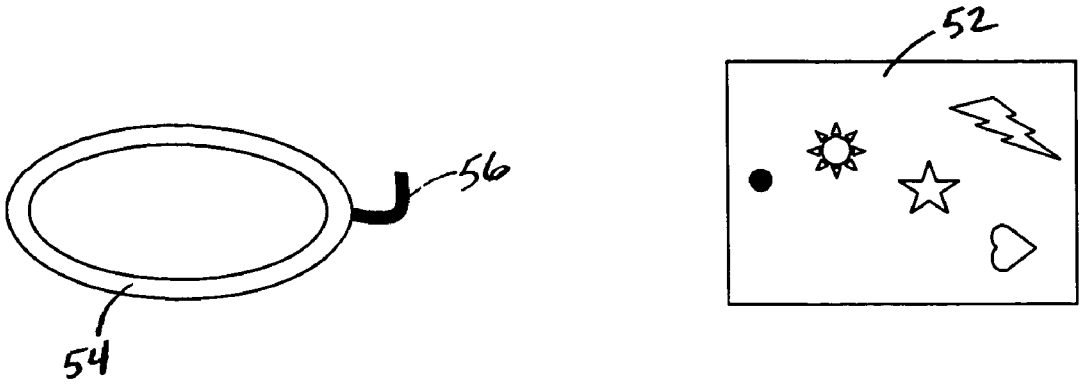
FIG. 7*a* illustrates a stencil and stencil ring.
Figure 7B:
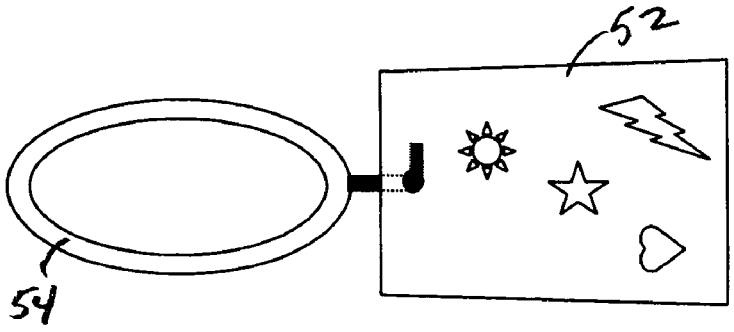
FIG. 7*b* illustrates a stencil attached to a stencil ring.

The stencil fastener 53 is a ring 54 that is elastic or has a diameter slightly bigger than the projection. The ring 54 has a means for fastening the stencil 52 to the ring 54, such as a nib 56 or pinch clip, both illustrated in FIGS. 7*a* and 7*b*. The stencils are made of firm, but preferably flexible, material such as plastic or paper. Various designs are cut out of the stencil, through which the paint is applied to the nails. The stencil may have a curved shape mimicking the curve of a nail to make French manicures easier.

Figure 8:
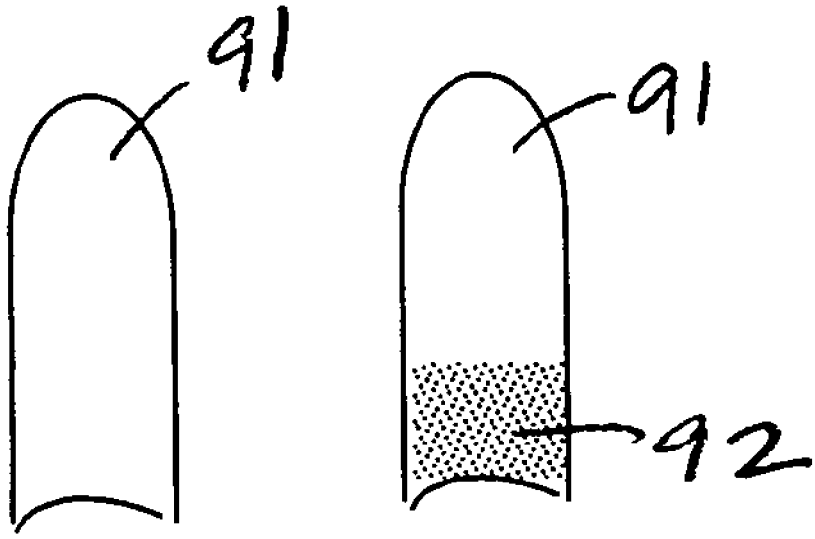
FIG. 8 illustrates practice nail forms.

Quality nail design takes practice. The airbrush user can practice on the projections or on his or her own nails, but constant removal of the paint can be messy. Another disadvantage of painting on ones own nails or the projections is that, if the user paints a particularly appealing design, the design is destroyed when the paint is removed. Therefore, the present invention also includes practice nail forms. See FIG. 8.

The practice forms 91 are thin, flexible, nail-shaped surfaces that are easily applied and removed to a user's nails or to the projections. Preferably a form is paper or very thin plastic with adhesive 92 on its backside that enables the form to be placed and easily repositioned on the user's nail or on a projection. It is contemplated that a portion of the back of the form be coated with an adhesive that has properties similar to that used on POST-IT® notes sold by 3M. The user then practices painting on the nail form and, when finished, either discards the practice form or saves if for later reference.

While there has been illustrated and described what is at present considered to be a preferred embodiment of the present invention, it will be understood by those skilled in the art that various changes and modifications may be made, and equivalents may be substituted for elements thereof without departing from the true scope of the invention. Therefore, it is intended that this invention not be limited to the particular embodiment disclosed as the best mode contemplated for carrying out the invention, but that the invention will include all embodiments falling within the scope of the appended claims.

I claim:

1. A device for stenciling fingernails comprising:

a) a stencil support having one or more projections wherein the stencil support is shaped like a hand;

b) a substantially elastic stencil fastener attachable to the stencil support wherein the stencil fastener is a ring; and c) a stencil attached to the stencil fastener wherein the stencil is attached to the ring with a spring clip or nib.

2. An airbrush comprising:

a. an air compressor;

b. an air hose connected to the air compressor;

c. a wand connected to the air hose;

d. a nozzle removably attached to the wand; and e. a paint container removably attached to the wand, the paint container having a supply of paint and a bored needle extending into the paint container;

wherein the airbrush operates by forcing air from the air compressor via the air hose through the wand and by the bored needle attached to the paint container to draw paint through the needle and aerosolize the paint, the aerosolized paint then being forced through the nozzle out of the wand so as to direct a spray of paint.

3. The device of claim 2 wherein the nozzle and paint container are integral with each other.

* * * * *